US007354253B2

(12) United States Patent
Yamauchi et al.

(10) Patent No.: US 7,354,253 B2
(45) Date of Patent: Apr. 8, 2008

(54) OIL PUMP

(75) Inventors: Kentaro Yamauchi, Aichi-ken (JP); Satoshi Kondo, Aichi-ken (JP); Nobuyuki Kawabata, Aichi-ken (JP); Takashi Imanishi, Aichi-ken (JP); Hiromichi Suemoto, Tokyo (JP)

(73) Assignees: Toyoda Koki Kabushiki Kaisha, Kariya-shi (JP); JTEKT Corporation, Osaka (JP)

( * ) Notice: Subject to any disclaimer, the term of this patent is extended or adjusted under 35 U.S.C. 154(b) by 404 days.

(21) Appl. No.: 10/516,298

(22) PCT Filed: Jun. 11, 2003

(86) PCT No.: PCT/JP03/07445

§ 371 (c)(1),
(2), (4) Date: Dec. 9, 2004

(87) PCT Pub. No.: WO2004/007966

PCT Pub. Date: Jan. 22, 2004

(65) Prior Publication Data

US 2005/0204738 A1 Sep. 22, 2005

(30) Foreign Application Priority Data

Jun. 13, 2002 (JP) ..... 2002-172967

(51) Int. Cl.
*F04B 49/00* (2006.01)

(52) U.S. Cl. ..... 417/310; 417/279; 417/307

(58) Field of Classification Search ..... 417/310
See application file for complete search history.

(56) References Cited

U.S. PATENT DOCUMENTS

| | | | | |
|---|---|---|---|---|
| 4,575,314 | A | 3/1986 | Teubler et al. | |
| 5,567,125 | A | 10/1996 | Noah et al. | |
| 5,782,615 | A * | 7/1998 | Noah et al. | 417/310 |

FOREIGN PATENT DOCUMENTS

| | | |
|---|---|---|
| JP | 184388/1984 | 12/1984 |
| JP | 90990/1987 | 6/1987 |
| JP | 2-139386 | 11/1990 |
| JP | 11-63270 | 3/1999 |
| WO | 96/13665 | 5/1996 |

* cited by examiner

*Primary Examiner*—Devon C. Kramer
*Assistant Examiner*—Patrick Hamo
(74) *Attorney, Agent, or Firm*—Oblon, Spivak, McClelland, Maier & Neustadt, P.C.

(57) ABSTRACT

An oil pump includes: a rotor 3 for actuating a pump action to suck oil in a suction passage 24 from a suction port 27 to supply oil to a delivery passage by way of a delivery port 19; and a flow control valve for returning an excessive oil from the delivery passage to the suction passage 24 as a returning flow of oil by way of a bypass passage 29 when a flow amount of oil is excessive in the delivery passage. A corrosion-proof member 9 having corrosion resistance is disposed at the position which faces to the returning flow of oil in the inner wall surface of at least one of the suction passage 24 and the bypass passage 29. The corrosion-proof member 9 has a discontinuous shape (for example a V-shape or a U-shape) in a circumferencial direction of center line P1 in a cross section which intersects the center line P1 at right angles.

12 Claims, 10 Drawing Sheets

OIL PUMP

TECHNICAL FIELD

The present invention relates to an oil pump mounted in vehicles, and the like. The present invention can be applied, for example, to oil pumps used for power steering apparatuses of vehicles.

BACKGROUND ART

There has been provided an oil pump mounted in vehicles. The oil pump has an actuating chamber, a suction port, a delivery port, a suction passage for supplying oil to the suction port, a delivery passage to which the oil is delivered from the delivery port, a bypass passage for communicating with the delivery passage and the suction passage, and a rotor for actuating a pump action. Rotation of the rotor causes a pump action which sucks oil in the suction passage from the suction port so as to supply the oil to the delivery passage by way of the delivery port. When a flow amount of the oil is excessive in the delivery passage, a flow control valve sends the excessive oil in the delivery passage to the suction passage as a returning flow of oil by way of the bypass passage, thereby supplying the oil suitably from the delivery passage to a hydraulic apparatus.

By the way, when the excessive oil returns from the delivery passage exhibiting a high pressure to the suction passage exhibiting a low pressure by way of the bypass passage, the oil returns at a considerably high speed. Therefore, when the oil pump is used in an excessive long period, or when the oil pump is used in severe conditions, there is a possibility that corrosion portions occur by direct collision of the returning flow of oil in an inner wall surface of the bypass passage and the suction passage. The reason is assumed that corrosion occurs on the basis of cavitation. Especially, in the case where the oil pump is set to be a high pressure and a high capacity, the pressure is high in the delivery passage so that the oil returns at a considerable high speed. So, there is a possibility to generate corrosion. Further, in the case where the suction passage is formed of aluminum alloy, there is a possibility that corrosion occurs.

As the oil pump for improving corrosion problem, Japanese Unexamined Utility Model Publication 2-139386 discloses the technology which installed the shell body having a cylindrical shape formed of steel material having corrosion resistance at portions of the direct collision of the returning flow of oil. The technology can prevent corrosion at the portion of the direct collision of the returning flow of oil, even if the oil returns at a considerably high speed.

However, according to the above-mentioned technology of Publication 2-139386, the shell body formed of steel material having corrosion resistance has a cylindrical shape exhibiting a passage for oil-flow. The shell body shows a cylindrical shape continuing one circle in a circumferential direction of a center line of this passage in the cross section thereof, thereby requiring an abounding material having corrosion resistance. Also, this construction narrows the flow area of the cross section in the passage for returning oil. If the flow area is increased in the cross section of the passage for returning oil, there is a disadvantage in view of layout of the way and a wall thickness of the housing, etc. since the oil pump requires a small-size. So there is a limit in increasing a flow area of a passage for returning oil.

The present invention has been developed in view of the above-mentioned circumstances. It is an object of the present invention to provide an oil pump which can reduce a using amount of material having corrosion resistance and can ensure a flow area of a way for returning flow of oil while ensuring corrosion resistance in a portion of the direct collision of the returning flow of oil.

DISCLOSURE OF THE INVENTION

The oil pump comprises: a base including an actuating chamber, a suction port, a delivery port, a suction passage for supplying oil to said suction port, a delivery passage into which the oil is delivered from the delivery port, and a bypass passage for communicating with the delivery passage and the suction passage;

a rotor disposed rotatablely in the actuating chamber for actuating a pump action to suck the oil in the suction passage from the suction port and to supply the oil to the delivery passage by way of the delivery port; and a flow control valve disposed in the base for returning an excessive oil from the delivery passage to the suction passage as a returning flow of oil by way of the bypass passage when a flow amount of oil is excessive in the delivery passage;

wherein a corrosion-proof member having corrosion resistance disposed in an inner wall surface of at least one of the suction passage and the bypass passage so as to face to the returning flow of oil, and wherein the corrosion-proof member has a discontinuous shape in a circumferrencial direction of a center line in a cross section which intersects the center line of one of the suction passage and the bypass passage at right angles.

According to the oil pump, a corrosion-proof member having corrosion resistance is disposed so as to face to the returning flow of oil at the inner wall surface of at least one of the suction passage and the bypass passage. So, even when the excessive oil returns from the delivery passage to the suction passage by way of the bypass passage, corrosion is suppressed in the portion of the direct collision of the returning flow of oil. Further, the corrosion-proof member has a discontinuous shape not to continue one circle in a circumferential direction of a center line of said one of the suction passage and the bypass passage in a cross section which intersects the center line at right angles. So, this construction can reduce a using amount of material having corrosion resistance and can ensure a flow area of the way for the returning flow of oil.

According to the oil pump of the present invention, the corrosion-proof member having corrosion resistance is disposed at the inner wall surface of at least one of the suction passage and the bypass passage. So, even when the excessive oil returns from the delivery passage to the suction passage by way of the bypass passage, corrosion is suppressed in the portion of the direct collision of the returning flow of oil. Further, the corrosion-proof member has a discontinuous shape not to continue one circle in the circumferential direction of the center line of the cross section which intersects the one of the suction passage and the bypass passage at right angles. So, this construction can reduce a using amount of material having corrosion resistance and can ensure the flow area of the passage for the returning flow of oil, as compared to the oil pump concerning Japanese Unexamined Utility Model Publication 2-139386.

According to a preferable mode of the oil pump of the present invention, the corrosion-proof member has a spring force for being expanded in an opening direction thereof in the cross section which intersects the center line of one of the suction passage and the bypass passage at right angles.

And, the corrosion-proof member is fixed at least in one of the suction passage and the bypass passage by the spring force thereof. This construction ensures a holding ability of the corrosion-proof member so as to suppress a displacement of the corrosion-proof member, even when the corrosion-proof member has a discontinuous shape in the cross section thereof.

According to a preferable mode of the oil pump of the present invention, the corrosion-proof member has a V-shape, a U-shape, or a C-shape in the cross section which intersects the center line of one of the suction passage and the bypass passage at right angles. This case allows the corrosion-proof member to exhibit a spring force for opening thereof; so, the corrosion-proof member is fixed at least in said one of the suction passage and the bypass passage by spring force. This case ensures a holding ability of the corrosion-proof member so as to suppress a displacement of the corrosion-proof member, even when the corrosion-proof member has a discontinuous shape in the cross section thereof. Installation of the corrosion-proof member using a spring force can enhance the holding of the corrosion-proof member. This case allows a construction that the corrosion-proof member has one of a substantial V-shape, a substantial U-shape, and a substantial C-shape.

According to a preferable mode of the oil pump of the present invention, at least said one of the suction passage and the bypass passage has a long sideways shape including an oval shape with a long diameter and a short diameter in the cross section thereof, and the corrosion-proof member has at least one of a V-shape, a U-shape, a substantial V-shape, and a substantial U-shaped state. This case enhances a holding ability of the corrosion-proof member so as to suppress a displacement of the corrosion-proof member. This case allows a mode in which at least a portion being in contact with oil in the corrosion-proof member is mainly formed of ferrous material selected from a group of alloy steel and carbon steel, or ceramic material.

BEST MODES FOR CARRYING OUT THE INVENTION

Figure 1:
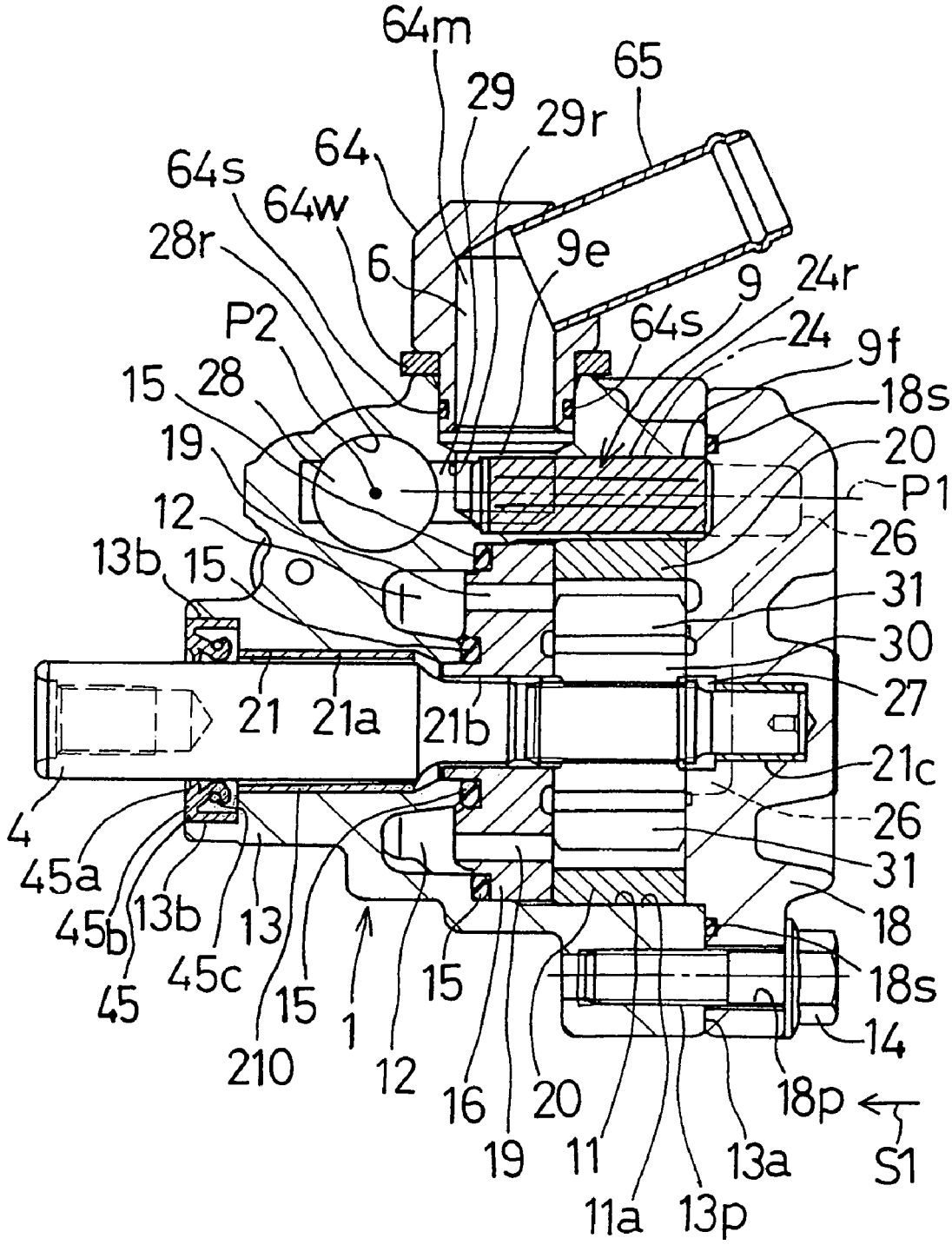
FIG. 1, concerning a mode, is a sectional view of an oil pump.

A first mode of the present invention will hereinafter be described with reference of the drawing. FIG. 1 shows a sectional view of an oil pump having a vane style. The oil pump concerning the present mode is used for power steering machines for assisting operations of steering of a handle of vehicles. The oil pump is mounted in vehicles to be rotated by use of a crank shaft of an engine. As shown in FIG. 1, in the oil pump, a base 1 includes: a housing 13 which is formed of aluminum or aluminum alloy and which has an actuating chamber 11 formed by an inner wall surface 11*a* and a discharging room 12 for communicating with the actuating chamber 11; a first side plate 16 which is formed of aluminum or aluminum alloy to be placed for facing to the delivering room 12 and which is inserted into the actuating chamber 11 by way of a seal portion 15 having a ring shape; and a second side plate 18 which is formed of aluminum or aluminum alloy and which is integrally fixed in a mounting end face 13*a* of the housing 13. The housing 13 is referred as a front housing.

As shown in FIG. 1, each of mounting bolts 14, working as a mounting tool, is inserted into a hole 18*p* of the second side plate 18 to be screwed to a screwed hole 13*p* of the housing 13; thus, the second side plate 18 is fixed at the mounting end face 13*a* of the housing 13 by way of a seal portion 18*s* having a ring shape. In a thickness direction of the first side plate 16, a delivery port 19 is disposed to communicate the delivering room 12 and the actuating chamber 11. A cam ring 20 is placed between the first side plate 16 and the second side plate 18 so as to be fitted in the actuating chamber 11.

As shown in FIG. 1, the housing 13 of the base 1 has a shaft hole 21 connected to the actuating chamber 11. The shaft hole 21 includes a first shaft hole 21*a* having a relatively large diameter formed in the housing 13; a second shaft hole 21*b* having a relatively small diameter formed in the first side plate 16; and a third shaft hole 21*c* having a relatively small diameter formed in the second side plate 18.

Figure 2:
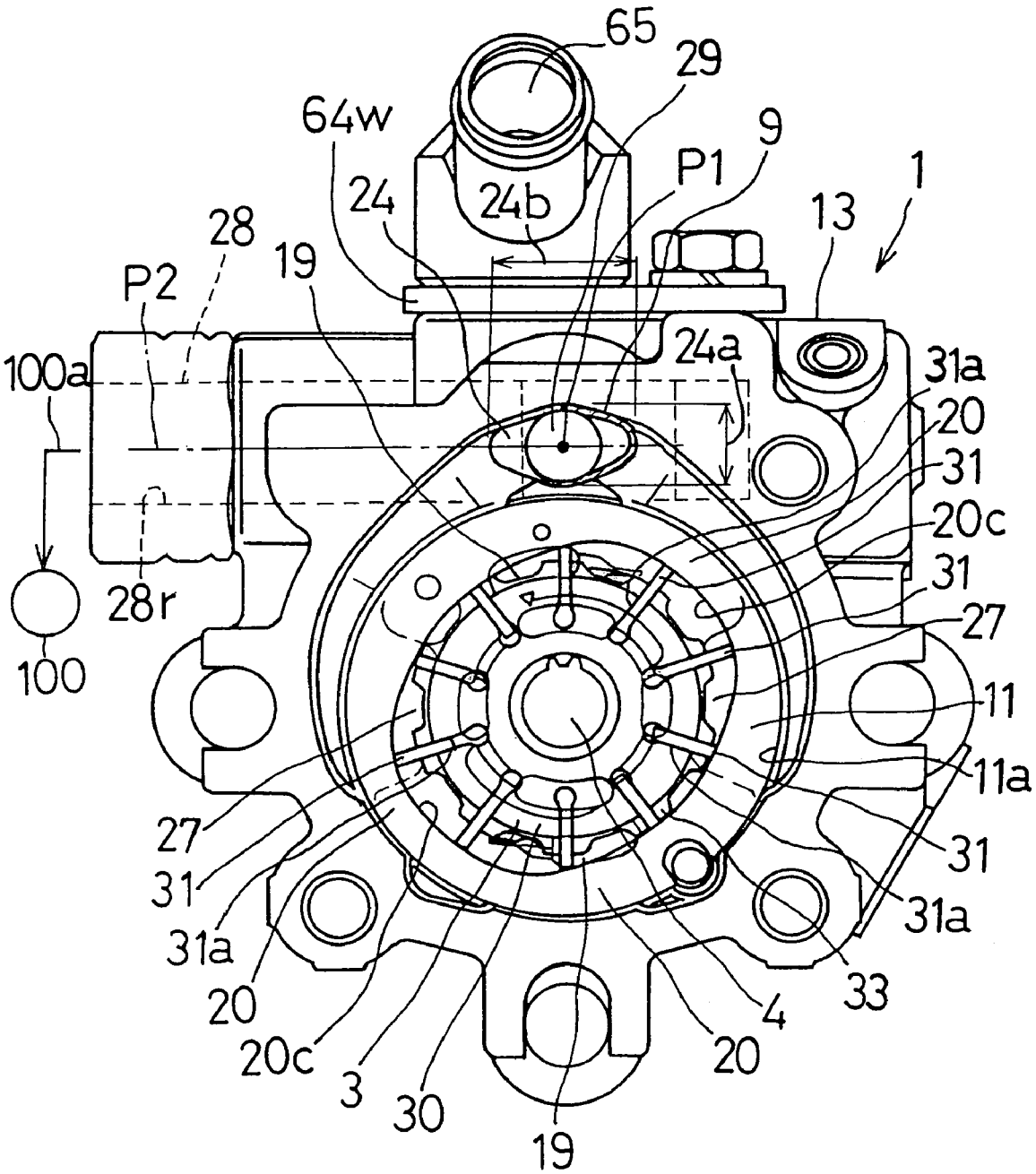
FIG. 2, concerning the mode, is a side view which shows the oil pump shown in FIG. 1 with removing a second side plate and which shows the oil pump from the arrow direction of S1.
Figure 3:
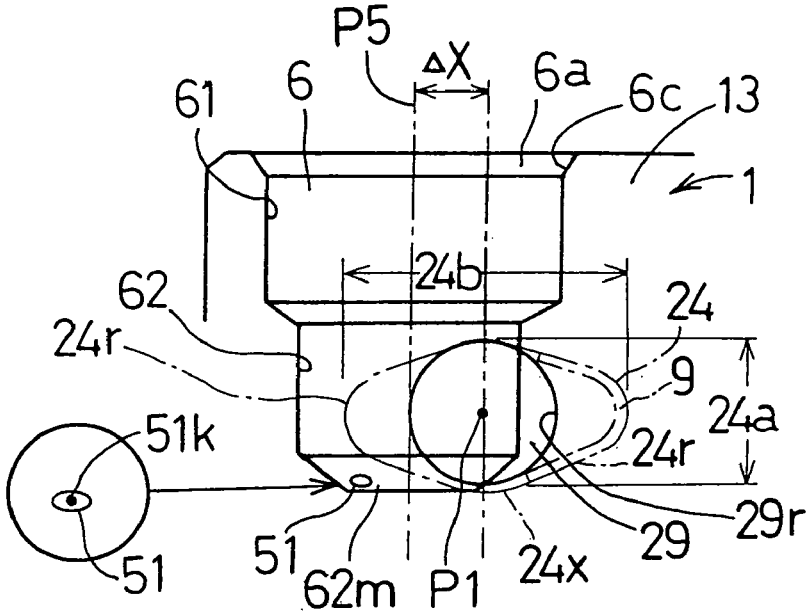
FIG. 3, concerning the first mode, is a sectional view (hatching omission) near a sucking hole.

As shown in FIG. 1, the housing 13 of base 1 includes a suction passage 24 which is disposed and paralleled along a center line of the shaft hole 21 to be connected with the suction port 27 by way of a suction communicating way 26 of the second side plate 18. As shown in FIGS. 2 and 3, the suction passage 24 has not a perfect circle shape but an oval shape having a long diameter 24*b* and a short diameter 24*a* in the cross section thereof. The long diameter 24*b* in the cross section of the suction passage 24 is extended along in the direction of the center line P2 of the delivery passage 28.

The short diameter 24*a* in the cross section of the suction passage 24 is extended along in the direction intersecting the center line P2 of the delivery passage 28. As shown in FIG. 1, the center line of the bypass passage 29 is extended along an extending line of the center line P1 of the suction passage 24. So, the bypass passage 29 and the suction passage 24 coaxially communicate with each other. The suction passage 24 is larger than the bypass passage 29 in flow area in the cross section.

As shown in FIG. 2, a rotor 3 is rotatably attached in the actuating chamber 11, concretely, to be rotatably disposed in the cam ring 20 attached in the actuating chamber 11. The rotor 3 actuates a pomp action to suck oil from the suction port 27 to discharge oil to the delivering room 12 with the rotation by way of the delivery port 19, further supplying the oil to the suction passage 28. As shown in FIG. 2, the rotor 3 has: a rotating body 30 for being rotated in the cam ring 20: and a plurality of vanes 31 inserted in each of grooves 31*a* formed at the periphery of the rotating body 30 so as to move in a radiant direction. The neighboring vanes 31 constitute a plurality of rooms 33. Still, the cam ring 20 has a cam surface 20*c* at an inner circumferrencial surface thereof. With rotation of the rotor 3, an outside edge of the vane 31 slides at the cam surface 20*c*.

As shown in FIG. 1, the housing 13 of the base 1 has the delivery passage 28 divided by an inner surface 28*r* thereof. The delivery passage 28 has a circular shape in the cross section thereof. The delivery passage 28 is formed in the housing 13 of the base 1 in such a manner so as to connect the delivering room 12 to communicate with the actuating chamber 11 by way of the delivering room 12 and the delivery port 19. The center line P2 of the delivery passage 28 is extended along the direction which intersects the center line P1 of the suction passage 24. The delivery passage 28 communicates with the suction passage 24 by way of the bypass passage 29.

As shown in FIGS. 2 and 3, the bypass passage 29 is divided by the inner wall surface 29*r* thereof to exhibit a circular shape in the cross section thereof. The inner wall surface 29*r* of the bypass passage 29 is smaller than the delivery passage 28 in inner diameter. Also, the inner wall surface 29*r* is smaller than the long diameter 24*b* of the suction passage 24 in diameter length, and it is set to be the substantially same as the short diameter 24*a* of the suction passage 24 in diameter length.

As shown in FIG. 1, the drive shaft 4 is rotatably held in the shaft hole 21 by way of a metal bearing 210 so as to engage with the hole of the rotating body 30 of the rotor 3. Therefore, when the drive shaft 4 coupled to the crank shaft of the engine rotates, the rotor 3 is rotated therewith. When the drive shaft 4 rotates in the circumferrencial direction of the center line thereof, the rotor 3 and the vanes 31 rotate in the same direction in the cam ring 20. So, a tip of the vane 31 is moved along the cam surface 20*c* of the cam ring 20. The neighbouring vanes 31 constitute the rooms 33. At the side of the suction port 27, the volume of the room 33 is set to be relatively large to ensure an ability for sucking oil from the suction port 27: at the side of the delivery port 19, the volume of the room 33 is set to be relatively small.

As shown in FIG. 1, a seal mounting position 13*b* is formed at a portion which faces to the shaft hole 21 of the housing 13. A seal member 45 has a ring shape to be placed at the seal mounting position 13*b* in a boundary zone between the drive shaft 4 and the shaft hole 21. The seal member 45 seals the aforesaid boundary zone to suppress oil-leakage from an external wall surface of the drive shaft 4. The seal member 45 includes: a seal portion 45*b* having a ring shape being formed of a sealing material and having a seal lip portion 45*a*; and a spring 45*c* having a ring shape to urge the seal lip portion 45*a* in an inner diameter direction thereof for enhancing a sealing ability.

Figure 4:
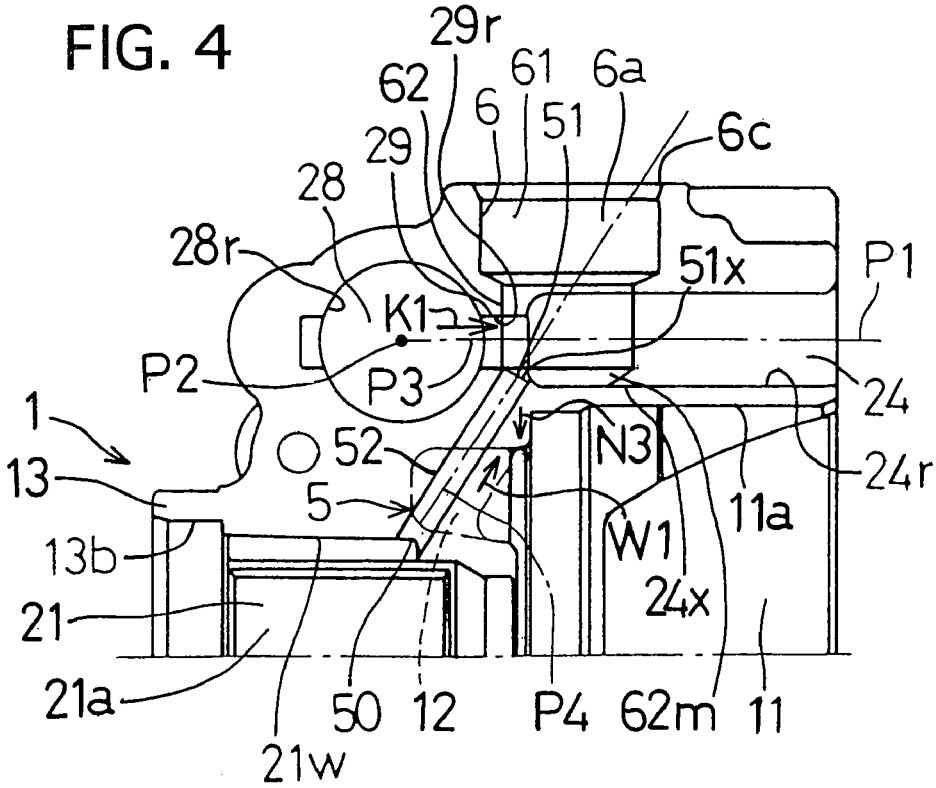
FIG. 4, concerning the first mode, is a sectional view (hatching omission) near a drain exit.

As shown in FIG. 4, the drain hole 5 has: a drain entrance 50 to be opened at an oil introduction passage 21*w* formed at the shaft hole 21 for communicating with the shaft hole 21; a drain exit 51 having an opening central 51*x* for communicating with the suction passage 24; and a drain communicating way 52 for communicating with the drain entrance 50 and the drain exit 51. The drain entrance 50 is opened near the side of the actuating chamber 11 in the oil introduction passage 21*w* of the shaft hole 21 as compared with the seal mounting position 13*b* for attaching the seal member 45. When the oil pump drives, the construction allows the oil pump to suck oil, being leaked in a clearance in the circumferrencial surface of the drive shaft 4, from the drain entrance 50 in an arrow direction of W1 so as to discharge oil to the drain exit 51 by way of the drain run way 52 as a drain. Still, as shown in FIG. 4, in view of layout of the oil pump, the drain hole 5 is set to be a small path having a small diameter to penetrate the housing 13 in a narrow portion between the delivery passage 28 and the actuating chamber 11. Here, the center line P4 of the drain run way 52 of the drain hole 5 is inclined with respect to both the center line P1 of the suction passage 24 and the center line P2 of the delivery passage 28.

As shown in FIG. 3, the sucking hole 6 for supplying oil is formed to communicating with the suction passage 24 and the bypass passage 29 in the housing 13 of the base 1. The suction hole 6 has a circular shape in the cross section thereof. The suction hole 6 coaxially includes: a first hole 61 having an inner diameter to be relatively larger; and a second hole 62 having an inner diameter to be relatively small. A conic surface 62*m* is formed at the tip of the second hole 62 to reach a bottom 24*x* of the actuating chamber 11 in the suction passage 24. As shown in FIG. 3, the drain exit 51 is opened at the conic surface 62*m* of the tip of second hole 62. That is to say, as shown in FIG. 3, the sucking hole 6 is deeply formed so that a depth end of the sucking hole 6 reaches a bottom 24*x* of the actuating chamber 11 in the suction passage 24. The drain exit 51 of the drain hole 5 is opened at the conic surface 62*m* of the second hole 62 of the sucking hole 6.

When oil returns from the delivery passage 28 exhibiting a high pressure to the suction passage 24 exhibiting a low pressure by way of the bypass passage 29, a super charge effect is expected for sucking oil effectively. When the sucking hole 6 is formed in the neighborhood of the delivery passage 28, effect is enhanced in ability for supplying oil from the sucking hole 6 to the suction passage 24. Still, as shown in FIG. 3, the center line P5 of the sucking hole 6 is set to displaced by $\Delta X$ with respect to the center line P1 (the center line P1 is correspondent to the center line of the bypass passage 29.)of the suction passage 24.

As shown in FIG. 1, in the sucking hole 6, a suction portion 64 with a sucking sleeve 65 is attached by way of a seal portion 64*s* having a ring shape and an engaging portion 64*w*. In operating the oil pump, the rotor 3 is rotated by the crank shaft with the vanes 31; so, the oil flows in the sucking sleeve 65, the hole 64*m* of the suction portion 64, the suction passage 24, the sucking run way 26, the suction port 27, the room 33 formed by the vanes 31, the delivery port 19, the delivering room 12, the delivery passage 28, the oil road 100*a*, and the hydraulic apparatus 100 in sequence.

Figure 5:
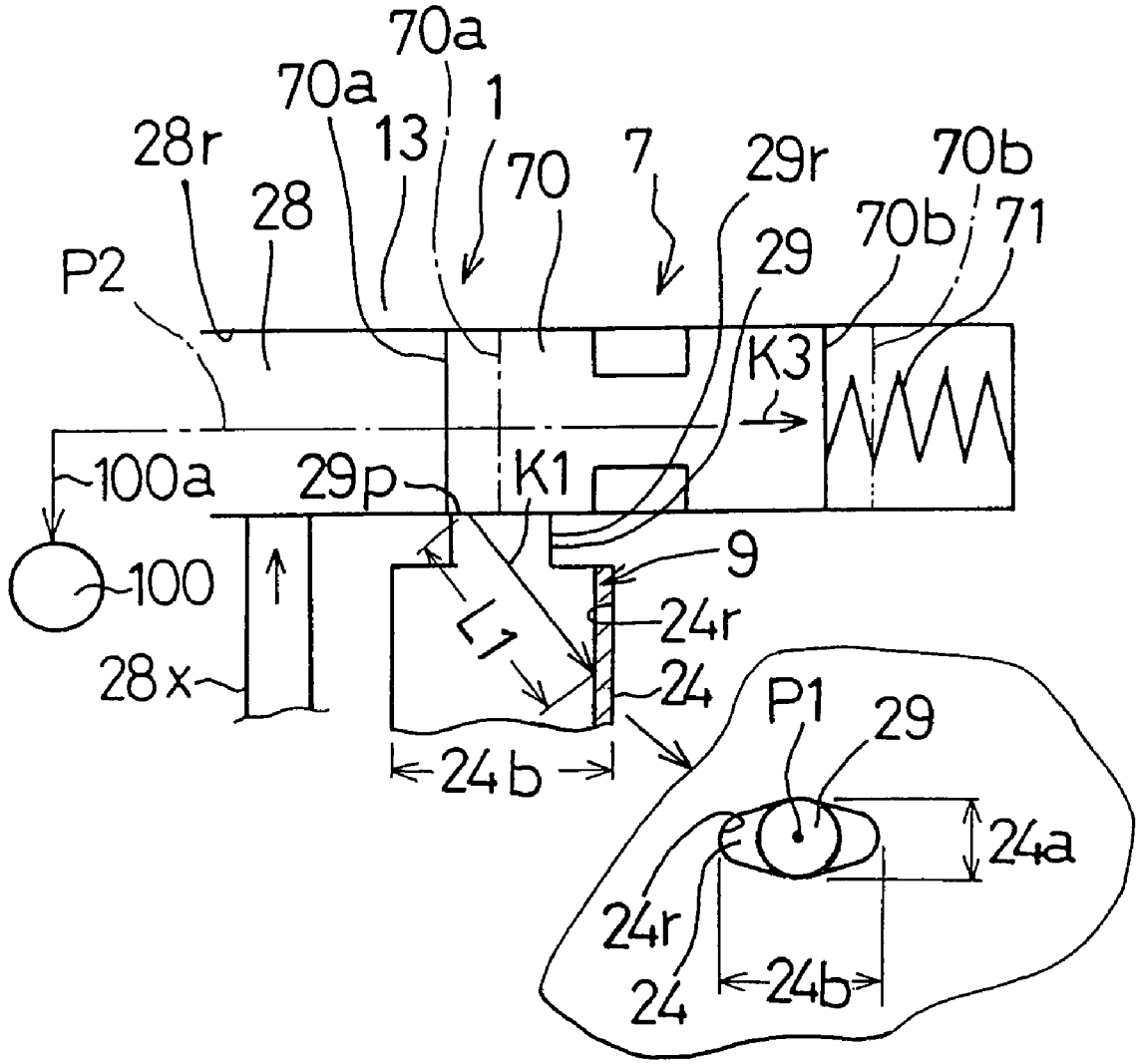
FIG. 5 is a conceptual view of a flow control valve.

FIG. 5 typically shows a conceptual scheme of the flow control valve 7 placed in the delivery passage 28. As shown in FIG. 5, the flow control valve 7 is set to adjust an oil flow in the delivery passage 28. The flow control valve 7 has: a spool 70 capable of reciprocating in the delivery passage 28; a forcing spring 71 working as a forcing means for urging the spool 70 in a direction for closing the entrance opening 29*p* of the bypass passage 29. The spool 70 has a tip end surface 70*a* and a rear end surface 70*b*.

The high-pressure oil of the delivery port 19 and the delivering room 12 is supplied to the delivery passage 28 by way of a supplying way 28*x* formed in the hosing 13. Further, the oil is supplied from the delivery passage 28 to the hydraulic apparatus 100 (refer to FIG. 5) by way of the oil road 100*a*. When the oil of delivery passage 28 exceeds a proper amount of oil, the pressure of oil moves the spool 70 to elastically contract the spring 71 (in the arrow direction of K3), further increasing an amount of opened area of the entrance opening 29*p* of the bypass passage 29. So, the excessive oil in the delivery passage 28 exhibiting a high pressure returns to the suction passage 24 exhibiting a low pressure in the arrow direction of K1 by way of the bypass passage 29. This allows the flow of oil to be set to be appropriate in an amount which is delivered from the delivery passage 28 to the hydraulic apparatus 100 by way of the oil road 100*a*.

Next, the present mode will be explained additionally. When the excessive oil returns from the delivery passage 28 exhibiting a high pressure to the suction passage 24 exhibiting a low pressure by way of the bypass passage 29 in the arrow direction of K1, the oil returns generally at a considerably high speed. So, if the use period of the oil pump is prolonged, corrosion may occur in the position where the returning flow of oil directly collides with the inner wall surface 24*r* of the suction passage 24. The reason is assumed that the corrosion is generated because of errosion and the like resulting from cavitation. Especially, when the oil pump is set to be a high pressure and a high capacity, a pressure is high in the delivery passage 28 and an oil flow amount is large, the oil generally returns at a considerably high speed. Accordingly, there is a possibility that the corrosion occurs in the position where the returning flow of oil directly collides with the inner wall surface 24*r* of the suction passage 24. Still, the housing 13 with the suction passage 24 is mainly formed of aluminum or aluminum alloy for lightening.

Figure 6:
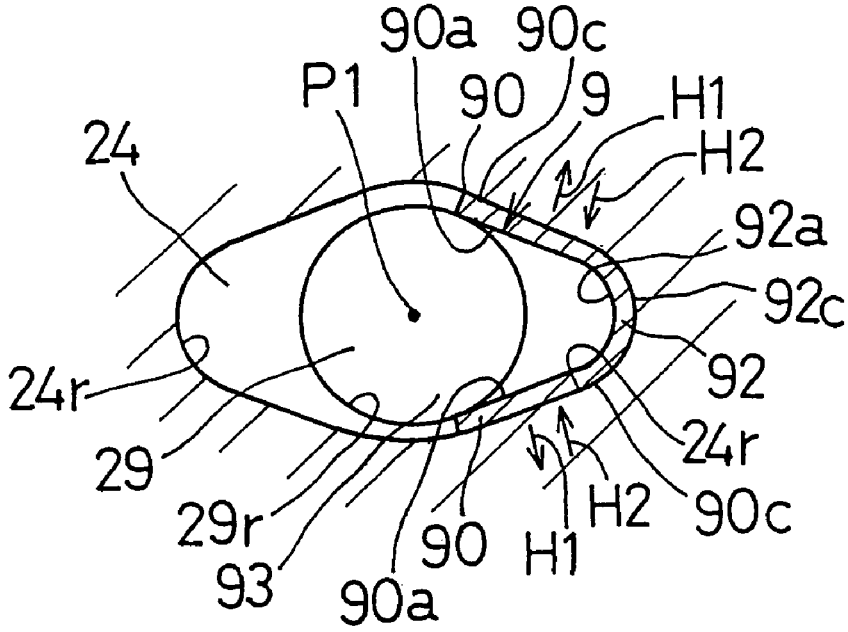
FIG. 6, concerning the first mode, is a sectional view which shows the vicinity of a suction passage installing a corrosion-proof member.

In this point, according to the present mode, as shown in FIGS. 1, 2, 5 and 6, the corrosion-proof member 9 with corrosion resistance is used as a different body with respect of the housing 13. In short, the corrosion-proof member 9 is installed at the position which faces to the returning flow of oil in the inner wall surface 24*r* of the suction passage 24. The corrosion-proof member 9 has a discontinuous shape not to continue one circle in the circumferrencial direction of the center line P1 in the cross section intersecting the center line P1 of the suction passage 24. Namely, as shown in FIG. 6, the corrosion-proof member 9 has a V-shape or a U-shape in the cross section intersecting the center line P1 of the suction passage 24.

That is to say, the corrosion-proof member 9 has a correspondent shape or a substantially correspondent shape with respect to the inner wall surface 24*r* of the suction passage 24. The corrosion-proof member includes: a pair of side portions 90 facing to each other at a predetermined distance to form a space interval 93; and a connecting portion 92 for connecting a pair of portions 90. The portion 90 has: facing surfaces 90*a* which face to each other; and back-facing surfaces 90*c* which oppositely face to each other and which face to the inner surface 24*r* of the suction passage 24. The connecting portion 92 has: a facing surface 92*a* which faces to a passage portion of the suction passage 24; and a back-facing surface 92*c* which faces to the inner wall surface 24*r* of the suction passage 24.

Before installing the corrosion-proof member 9 in the suction passage 24, the portion 90 of the corrosion-proof member 9 has a spring force to expand thereof in an opening direction thereof (the arrow direction of H1 shown in FIG. 6). Then, in the installing of the corrosion-proof member 9, the portions 90 are transformed in a direction to close each other (the arrow direction of H2 shown in FIG. 9) so as to narrow a space interval between portions 90. Next, the corrosion-proof member 9 is inserted into the suction passage 24 so as to expand the portions 90. Therefore, the portions 90 of the corrosion-proof member 9 is fixed in the suction passage 24 by the spring force of the portions 90 of the corrosion-proof member 9.

As shown in FIG. 1, one end 9*e* of the corrosion-proof member 9 in a longitudinal direction is located in one side in the length direction of the suction passage 24 to approach the bypass passage 29. Also, the other end 9*f* in a longitudinal direction of corrosion-proof member 9 is located in the other end side in the length direction of the suction passage 24 to approach the second side plate 18. The corrosion-proof member 9 is formed of material which is advantageous in suppressing corrosion resulting from cavitation. In short, the corrosion-proof member 9 is formed of material having an average higher-hardness to enhance corrosion resistance, as compared with aluminum alloy. Concretely, the corrosion-proof member 9 is formed of ferrous material such as steel alloy (for example stainless steel), carbon steel (for example hardened steel), or ceramic material as base material.

According to the present mode, the suction passage 24 has not a perfect circle shape but an ellipse shape having a short diameter 24*a* and a long diameter 24*b* in the cross section thereof. The corrosion-proof member 9 forcibly comes into contact with the inner wall surface 24*r* of the suction passage 24. This construction suppresses the corrosion-proof member 9 from being displaced in the circumferrencial direction of the suction passage 24 in the cross section intersecting the center line P1 of the suction passage 24, further enhancing an ability of holding the corrosion-proof member 9. According to the present mode, even when the oil pump is set to be high pressure and large capacity, this construction suppresses the displacement of the corrosion-proof member 9 and prevents the inner wall surface 24*r* of the suction passage 24 from generating corrosion throughout a long term.

Also, according to the present mode, as understood from FIG. 5, the long diameter 24*b* in the suction passage 24 is set to be along the center line P2 of the delivery passage 28. So, This construction increases a distance L1 (refer to FIG. 5), as compared with the case where the suction passage 24 has a perfect circle shape in the cross section thereof. Here, L1 means a distance from the entrance opening 29*p* of the bypass passage 29 to a direct collision portion of the returning flow of oil in the corrosion-proof member 9 installed at the inner wall surface 24*r* of the suction passage 24. Thus, This construction is advantageous in mitigating a direct collision of the returning flow of oil and in extending life of the corrosion-proof member 9.

In addition, according to the present mode, as understood from FIG. 3, the corrosion-proof member 9 is installed in the position where the drain exit 51 and the corrosion-proof member 9 hold the center line P1 of the suction passage 24 in the cross section which intersects the center line P1 of the suction passage 24. Therefore, as shown in FIG. 3, even if a cross sectional shape of the suction passage 24 is a bilateral symmetry state by way of the short diameter 24*a*, since workers, etc. can recognize the drain exit 51 from the sucking hole 6, and since the drain exit 51 is formed in the opposite side with respect to the mounting position of the corrosion-proof member 9, the drain exit 51 can work as a marking spot in mounting the corrosion-proof member 9. Therefore, it is advantageous to solve a confusion of the position of the corrosion-proof member 9 in mounting the corrosion-proof member 9.

The present mode allows the corrosion-proof member 9 to be kept in the installed state. Or, the present mode allows the corrosion-proof member 9 to be removable and exchangeable. If the oil pump is used in a long term, the corrosion-proof member 9 can be removed from the suction passage 24 to be exchanged in the condition that the second side plate 18 is removed from the housing 13.

(Second to Fourth Modes)

Figure 7:
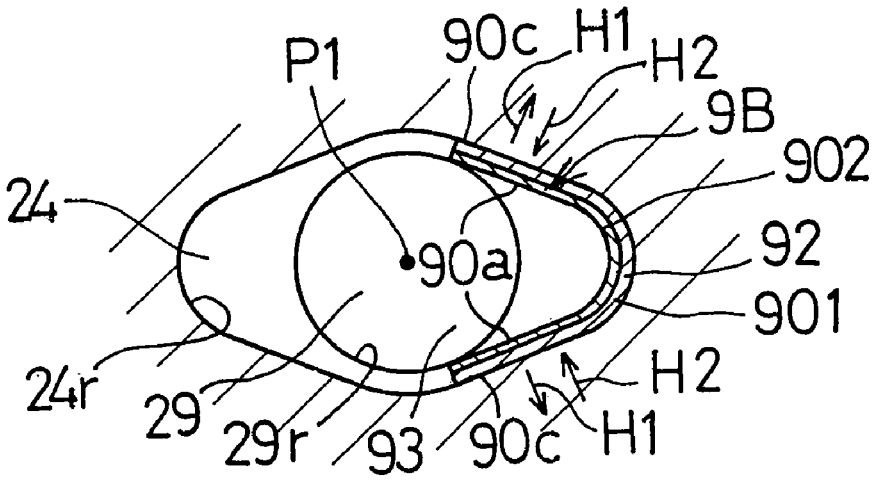
FIG. 7, concerning a second mode, is a sectional view which shows the vicinity of a suction passage installing a corrosion-proof member.
Figure 8:
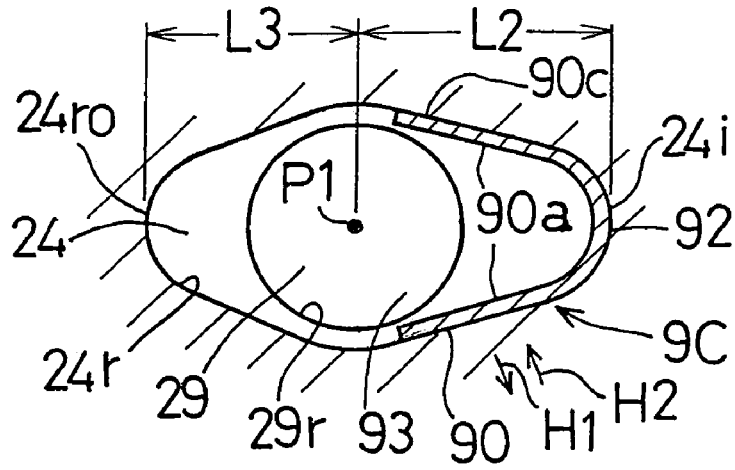
FIG. 8, concerning a third mode, is a sectional view which shows the vicinity of a suction passage installing a corrosion-proof member.
Figure 9:
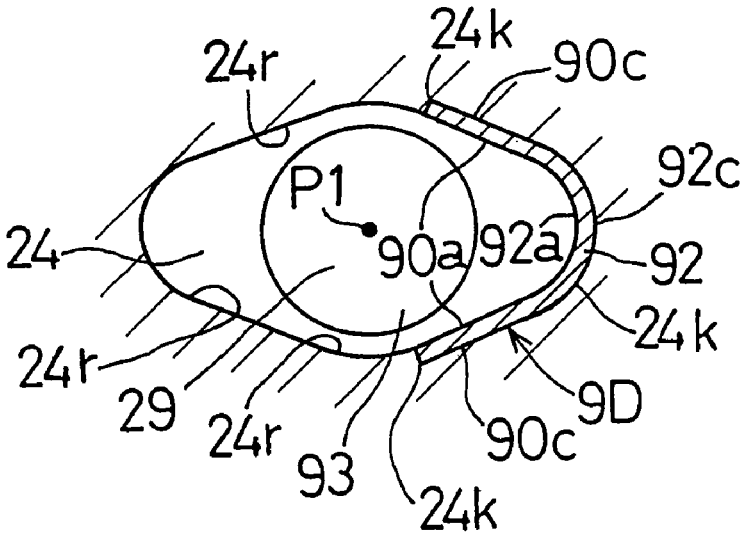
FIG. 9, concerning a forth mode, is a sectional view which shows the vicinity of a suction passage installing a corrosion-proof member.

FIGS. 7 to 9 show the second to fourth modes. The second to fourth modes are fundamentally the same as the first mode shown in FIGS. 1 to 6 in construction, function, and effect. The common reference sign shows the common portion. Like the second mode shown in FIG. 7, the corrosion-proof member 9B can be set in the construction where it includes: a first layer 901 forming a base material and having a V-shape or a U-shape; and a second layer 902 which is disposed at the side facing to the center line P1 of the suction passage 24 out of the first layer 901 and which is more rich than the first layer 901 in corrosion resistance. It is possible that the second layer 902 is formed of material having corrosion resistance—carbon steel, alloy steel such as stainless steel, or ceramics. Since the second layer 902 is more rich than first layer 901 in corrosion resistance, it is possible that the first layer 901 constituting a base material is formed of ferrous material, aluminum, or aluminum alloy. Also, it is possible that the second layer 902 is formed having corrosion rich-resistance by diffusing alloying elements (for example, at least one of chromium, nickel, molybdenum, tungsten, etc.) to the material constituting the corrosion-proof member 9B. Further, it is possible that the second layer 902 is formed having corrosion rich-resistance by forming the hardened layer only in the material surface layer constituting the corrosion-proof member 9B.

The present mode allows not only that the cross section of the suction passage 24 has a bilateral symmetry state by way of the short diameter 24*a*, as shown in FIG. 6, but also that distance L2 is set longer than distance L3 (L2>L3), according to the third mode shown in FIG. 8. Here, in the cross section of the suction passage 24, as shown in FIG. 8, distance L2 shows a distance from the center line P1 of the suction passage 24 to one outside edge 24*i*: distance L3 shows a distance from the center line P1 to the other outside edge 24*ro*. When the corrosion-proof member 9C is installed at the side of the outside edge 24*i* of the suction passage 24, it is possible that distance L1 (refer to FIG. 5) is increased. Here, distance L1 shows a distance from the bypass entrance of the bypass passage 29 to the corrosion-proof member 9C installed at the inner wall surface 24*r* of the suction passage 24. So, this is advantageous in mitigating a direct collision of the returning flow of oil and in extending life of the corrosion-proof member 9C.

According to the fourth mode shown in FIG. 9, the inner wall surface 24*r* of the suction passage 24 has an engaging portion 24*k* to form a shallow groove for engaging the corrosion-proof member 9D. This construction achieves that the facing surface 90*a* of the portion 90 of the corrosion-proof member 9D and the facing surface 92*a* of the connecting portion 92 are set to be flat or substantially flat with the inner wall surface 24*r* of the suction passage 24, as shown in FIG. 9. This construction is advantageous in ensuring a flow cross sectional area of the suction passage 24 and in ensuring a smooth flow.

The above-mentioned mode allows that the corrosion-proof member 9 is fixed by the spring force of the corrosion-proof member 9. Another mode allows that a corrosion-proof member is formed of metal foil for lightening to have a V-shape or a U-shape in the cross section thereof, and that the corrosion-proof member is forcibly fixed at the inner wall surface 24*r* of the suction passage 24 by use of a hydroforming method, a rubber pressure molding method, or calking jig.

According to the above-mentioned mode, the corrosion-proof member 9 has a V-shape or a U-shape in cross section thereof. However, in the case where the suction passage 24 is a perfect circle shape or an approximately perfect circle in the cross section thereof, it is possible that the corrosion-proof member 9 is a C-shape in cross section thereof. Even if the cross section is a C-shaped, it is possible that the corrosion-proof member is effectively held by spring force thereof so as to suppress a displacement of the corrosion-proof member. The above-mentioned housing 13 is formed of aluminum or aluminum alloy—material is not restricted this. So, it is also possible to use ferrous material to the housing 13. According to the above-mentioned mode, the corrosion-proof member 9 is disposed in the suction passage 24—however, it is also possible the corrosion-proof member is disposed in the bypass passage 29.

(Fifth Mode)

Figure 10:
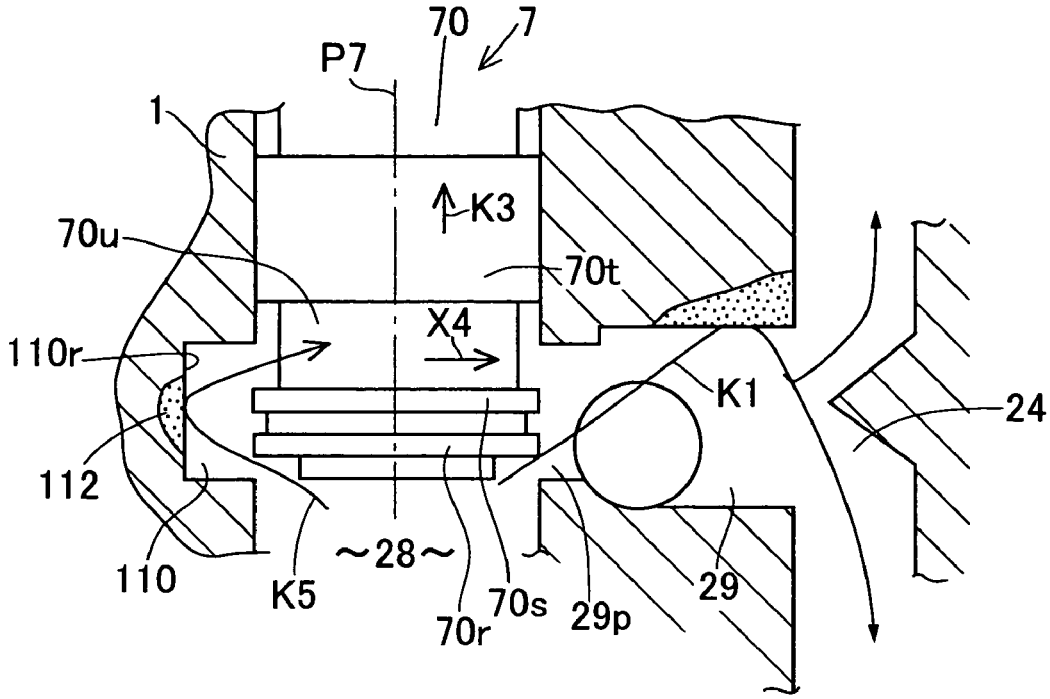
FIG. 10, concerning a comparative mode, is a sectional view which shows the vicinity of a suction passage in which corrosion is to be generated.
Figure 11:
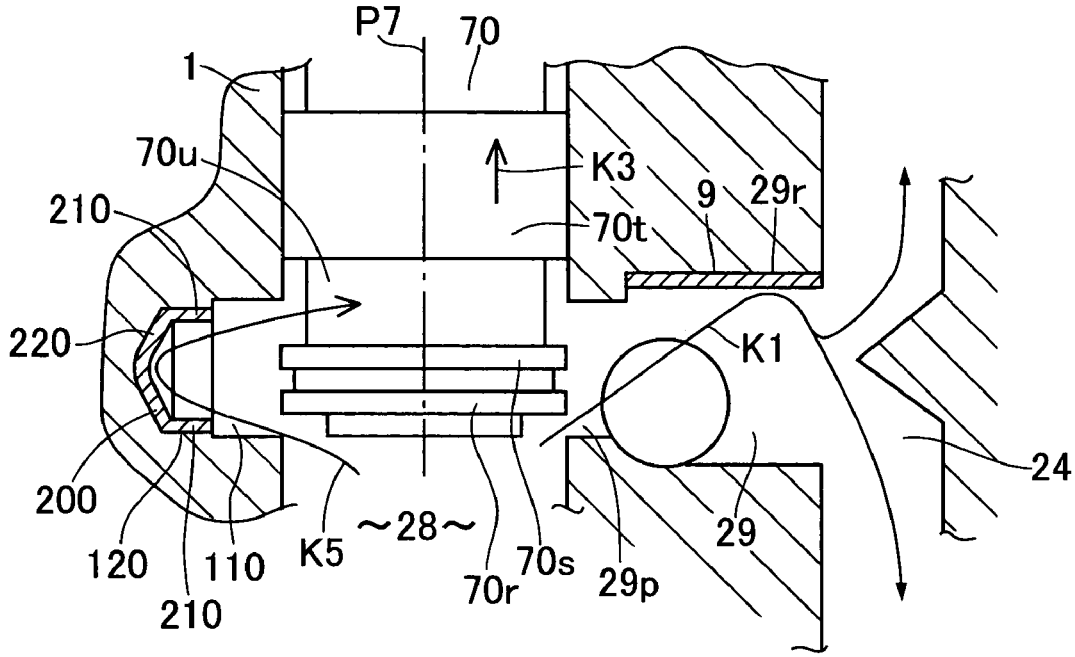
FIG. 11, concerning a fifth mode, is a sectional view which shows the vicinity of a suction passage installing the corrosion-proof member and which shows the vicinity of a balancing concavity installing a second corrosion-proof member.

FIG. 10 shows a comparative mode. FIG. 11 shows the fifth mode which improves this comparative mode. The fifth mode is fundamentally the same as the first mode shown in FIGS. 1 to 6 in construction, function, and effect. The common reference sign shows the common portion. It will be explained from the comparative mode shown in FIG. 10 in convenience of description. A flow control valve 7 has a spool 70 which moves in the delivery passage 28 in response to the pressure of the delivery passage 28. The spool 70 has ring-shaped land portions 70*r*, 70*s*, and 70*t* disposed in a circumference of the center line P7, and a ring groove 70*u*. Then, the base 1 has the balancing concavity 110 having a hole so as to communicate with the delivery passage 28 in the position which faces to the bypass passage 29 of the delivery passage 28. The balancing concavity 110 communicates with the bypass passage 29 by way of the ring groove 70*u* of the spool 70.

In driving the oil pump, the delivery passage 28 exhibits a relatively high pressure with a pump action: the suction passage 24, sucking side, exhibits a relatively low pressure. Therefore, when the spool 70 is escaped in a escaping direction (the arrow direction of K3), the entrance opening 29*p* of the bypass passage 29 is released; so, the excessive oil of the delivery passage 28 returns to the suction passage 24 by way of the bypass passage 29. At this time, there is a possibility that the center line P7 of the spool 70 is displaced to approach the suction passage 24 in the arrow direction of X4 (refer in FIG. 10), by a differential pressure between the delivery passage 28 exhibiting a high-pressure side and the suction passage 24 exhibiting a low-pressure side. Then, like the comparative mode shown in FIG. 10, the balancing concavity 110 having the hole is formed in the position which faces to the bypass passage 29 out of the delivery passage 28. In this case, by way of the bypass passage 29, the excessive oil returns from the delivery passage 28 exhibiting a high-pressure side to the suction passage 24 exhibiting a low-pressure side, the oil flows from the delivery passage 28 in the arrow direction of K1; further, the oil flows from the delivery passage 28 to the concavity 110 in the arrow direction of K5. Still further, the oil returns to the bypass passage 29 by way of the ring groove 70*u* of the spool 70. So, the spool 70 is improved in balance, and thereby the displacement of the spool 70 is suppressed so as to improve a smooth movement of the spool 70.

However, according to the comparative mode shown in FIG. 10, when the excessive oil returns from the delivery passage 28 to the balancing concavity 110 in the arrow direction of K5 by opening the entrance opening 29*p* of the bypass passage 29 with the actuation of the spool 70, and the returning flow of oil may directly collide with the inner wall surface 110*r* of the balancing concavity 110 on occasion of the operating condition. So, when the oil pump is used in an excessively long term, or when the oil pump is drived in severe conditions, a corrosion portion 112 may occur at the inner wall surface 110*r* of the balancing concavity 110. The reason is assumed that corrosion is generated based on cavitation. Especially, in the case where the oil pump is set to exhibit a high pressure and a large capacity, since the delivery passage 28 shows a high pressure, the oil returns at a considerable high speed. So, there is a possibility that corrosion occurs. Then, according to the fifth mode, as shown in FIG. 11, the balancing concavity 110 has a mounting hole 120 at the bottom thereof. The mounting hole 120 is provided with a second corrosion-proof member 200 having corrosion resistance. The second corrosion-proof member 200 is disposed at the position which faces to the returning flow of oil (the arrow direction of K5). The second corrosion-proof member 200, having a cup-shape, includes a ring-shaped sidewall portion 210 and a bottom wall portion 220 connected with the sidewall portion 210. It is preferable that the bottom wall portion 220 have a roundness in the central region of the bottom wall portion 220. The second corrosion-proof member 200 is inserted and installed in the mounting hole 120 of the concavity 110. The second corrosion-proof member 200 is formed of the material which is advantageous in corrosion resistance so as to suppress corrosion resulting from cavitation. In short, the second corrosion-proof member 200 has an average hardness which is higher than aluminum alloy, thereby having corrosion resistance. Concretely, the second corrosion-proof member 200 is formed of ferrous materials such as alloy steel and stainless steel, and carbon steel (for example, hardened steel), or ceramic material.

In the case where the entrance opening 29*p* of the bypass passage 29 is opened to return the excessive oil from the delivery passage 28 to the suction passage 24 by way of the bypass passage 29 with actuation of the spool 70, even when the returning oil flows into the balancing concavity 110 in the arrow direction of K5, it is possible to suppress corrosion in the concavity 110 and to extend life of the oil pump. Further, the mounting hole 120 is formed in the bottom surface of the balancing concavity 110 for attaching the second corrosion-proof member 200 to the mounting hole 120. So, this construction detaches the second corrosion-proof member 200 from the oil-collision portion (the arrow direction of K5) as much as possible, further improving the protection of the second corrosion-proof member 200.

In the present mode, as shown in FIG. 11, the corrosion-proof member 9 with corrosion resistance is installed at the position which faces to the returning flow of oil (the arrow direction of K1) in the inner wall surface 29*r* of the bypass passage 29, thereby suppressing corrosion at the inner wall surface 29*r* of the bypass passage 29.

(Sixth Mode)

Figure 12:
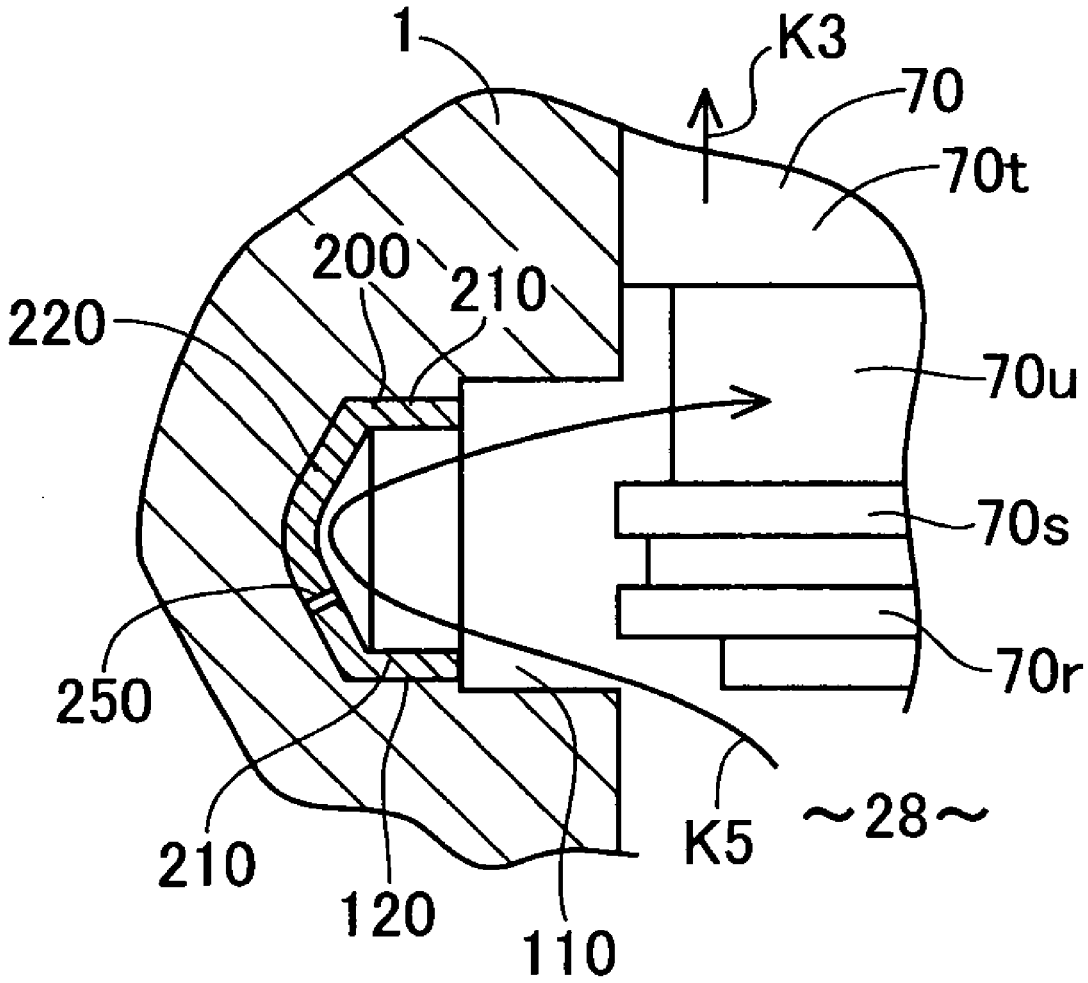
FIG. 12, concerning the sixth mode, is a sectional view which shows the vicinity of a balancing concavity installing a second corrosion-proof member.

FIG. 12 shows the sixth mode. The sixth mode is fundamentally the same as the fifth mode shown in FIG. 11 in construction, function, and effect. The common reference sign shows the common portion. According to the present mode, an air vent way 250 is formed in the bottom wall portion 220 of the second corrosion-proof member 200 having a cup shape. When the second corrosion-proof member 200 is inserted into the mounting hole 120 of the balancing concavity 110, there is a possibility that air remains between the mounting hole 120 and the second corrosion-proof member 200. Accordingly, there is sometimes a fear that the air is expanded and influences a mounting strength of the second corrosion-proof member 200. So, since the air vent way 250 is formed in the second corrosion-proof member 200, the air vent way 250 can cancel a possibility that air remains between the mounting hole 120 of the concavity 110 and the second corrosion-proof member 200 in mounting the second corrosion-proof member 200, further enhancing a mounting strength of the second corrosion-proof member 200.

(Seventh Mode)

Figure 13:
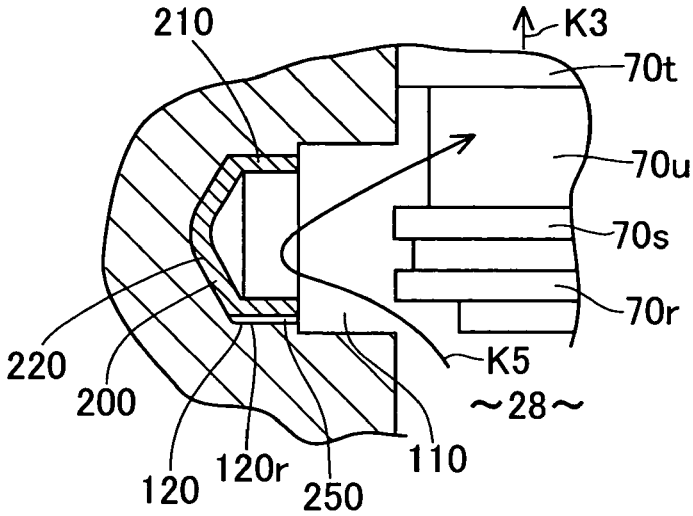
FIG. 13, concerning the seventh mode, is a sectional view which shows the vicinity of a balancing concavity installing a second corrosion-proof member.
Figure 14:
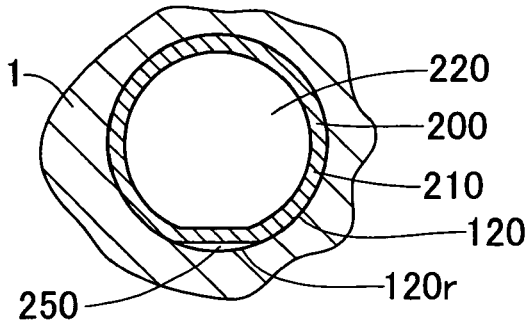
FIG. 14, concerning the seventh mode, is a cross-sectional view which shows the vicinity of a balancing concavity installing a second corrosion-proof member.

FIGS. 13 and 14 show the seventh mode. The seventh mode is fundamentally the same as the fifth mode shown in FIG. 11 in construction, function, and effect. The common reference sign shows the common portion. According to the present mode, as shown in FIGS. 13 and 14, the balancing concavity 110 is formed. In addition, a part of the circumferential direction in the sidewall portion 210 of the second corrosion-proof member 200 having a cup-shape is retracted in an axial direction of the sidewall portion 210. Thus, the air vent way 250 is formed between the sidewall portion 210 of the second corrosion-proof member 200 and the wall surface 120*r* of the mounting hole 120 of the balancing concavity 110. So, the air vent way 250 can cancel a possibility that air remains between the mounting hole 120 of the concavity 110 and the second corrosion-proof member 200, further enhancing a mounting strength of the second corrosion-proof member 200.

Figure 15:
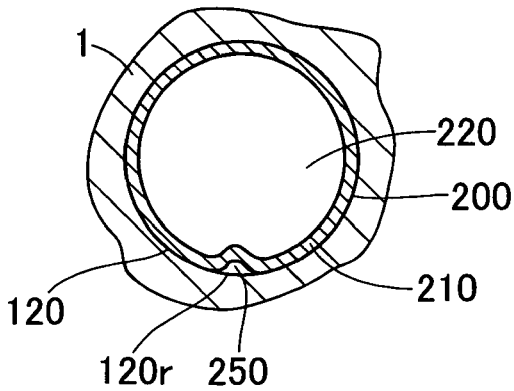
FIG. 15, concerning the eighth mode, is a cross-sectional view which shows the vicinity of a balancing concavity installing a second corrosion-proof member.

According to the present eighth mode shown in FIG. 15, it is also possible the air vent way 250 is formed between the second corrosion-proof member 200 and the wall surface 120*r* of the mounting hole 120 of the concavity 110 by forming a groove in the side wall portion 210 of the second corrosion-proof member 200 having a cup-shape.

(Ninth Mode)

Figure 16:
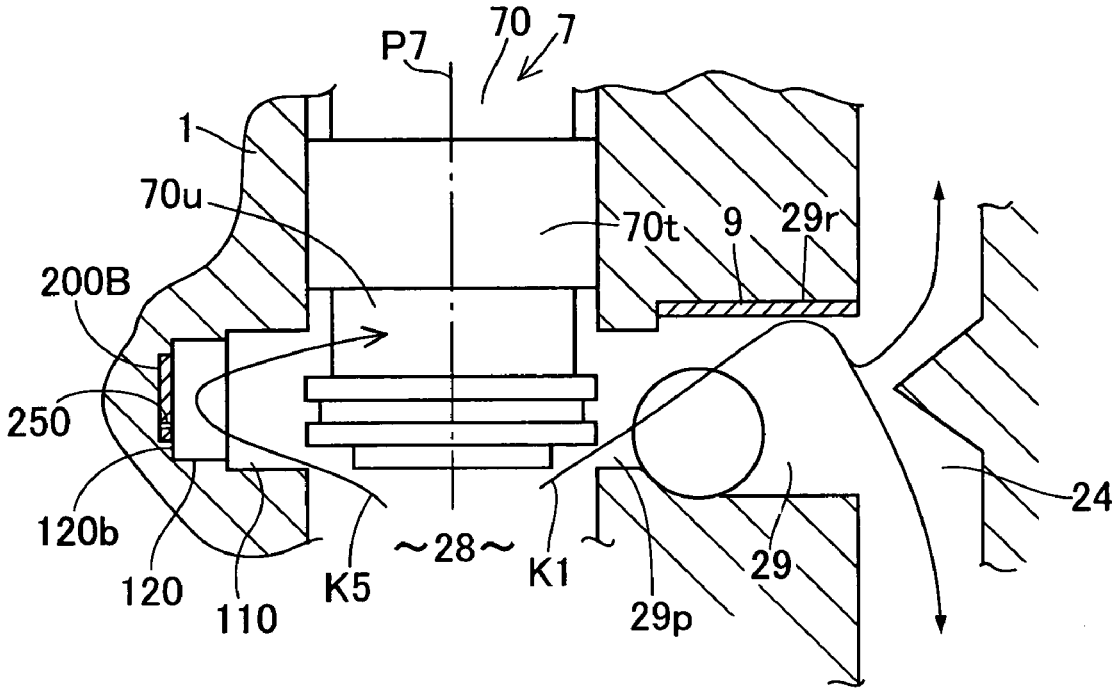
FIG. 16, concerning the ninth mode, is a sectional view which shows the vicinity of a suction passage installing a corrosion-proof member and which shows the vicinity of a balancing concavity installing a second corrosion-proof member.

FIG. 16 shows the ninth mode. The ninth mode is fundamentally the same as the fifth mode shown in FIG. 11 in construction, function, and effect. The common reference sign shows the common portion. According to the present mode, as shown in FIG. 16. According to the present mode, the second corrosion-proof member 200B having a plate shape is inserted into the mounting hole 120 of the balancing concavity 110. Thus, the second corrosion-proof member 200B is fixed at the bottom surface 120*b* of the mounting hole 120 of the balancing concavity 110. The air vent way 250 is formed in the second corrosion-proof member 200B having a plate shape composed of a disk or an angle plate, thereby enhancing a mounting strength of the second corrosion-proof member 200B.

In the present mode, as shown in FIG. 16, the corrosion-proof member 9 with corrosion resistance is installed at the position which faces to the returning flow of oil (the arrow direction of K1) in the inner wall surface 29*r* of the bypass passage 29, thereby suppressing corrosion at the inner wall surface 29*r* of the bypass passage 29.

Figure 17:
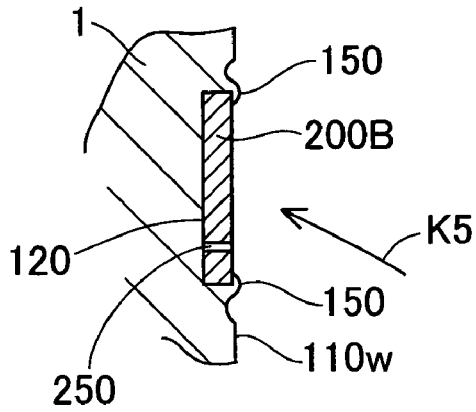
FIG. 17, concerning the tenth mode, is a sectional view which shows the vicinity of a balancing concavity installing a second corrosion-proof member.

According to the tenth mode shown in FIG. 17, after the second corrosion-proof member 200B is inserted into the mounting hole 120 of the balancing concavity 110, the wall surface 110*w* which is adjacent to the second corrosion-proof member 200B is strongly pressed by jig to form a calking portion 150 having a ring shape. The calking portion 150 can work as an engaging portion for engaging with the circumferrencial portion of the second corrosion-proof member 200 continuously or intermittently, thereby enhancing a mounting strength of the second corrosion-proof member 200B. Still, the air vent way 250 is not necessarily required.

(Addition)

The above-mentioned first mode is applied to the oil pump of vane style with a plurality of vanes 31; however, it is not restricted in this—it can be applied to an oil pump of a gear style. The above-mentioned first mode is applied to the oil pump for the power steering machine; however, it is not restricted in this—it can be applied to oil pumps for other applications. In the above-mentioned each mode, it is possible that corrosion-proof member 9, 9B, 9C, 9D, and the second corrosion-proof member 200, 200B can be fixed in the base 1 by placing, casting, welding, etc. In addition, the present invention is not limited to the above-mentioned mode. Appropriate modifications can be made in the present invention.

INDUSTRIAL APPLICABILITY

As mentioned above, the present invention can be applied, for instance, oil pumps for being used in hydraulic apparatuses such as a power steering machine of vehicles.

The invention claimed is:

1. An oil pump comprising:

a base including an actuating chamber, a suction port, a delivery port, a suction passage for supplying oil to said suction port, a delivery passage into which said oil is delivered from said delivery port, and a bypass passage for communicating with said delivery passage and said suction passage;

a rotor disposed rotatably in said actuating chamber for actuating a pump action to suck said oil in said suction passage from said suction port and to supply said oil to said delivery passage by way of said delivery port; and a flow control valve disposed in said base for returning an excessive oil from said delivery passage to said suction passage as a returning flow of oil by way of said bypass passage when a flow amount of oil is excessive in said delivery passage; and a corrosion-proof member having corrosion resistance, wherein said corrosion-proof member extends over less than half of the at least one of said suction passage and said bypass passage in a circumferential direction of a center line in a cross section which intersects said center line of one of said suction passage and said bypass passage at right angles and is circumferentially positioned in the at least one of said suction passage and said bypass passage to face the returning flow of oil.

2. The oil pump according to claim 1, wherein said corrosion-proof member has one of a V-shape, a U-shape, and a C-shape in said cross section which intersects said center line of one of said suction passage and said bypass passage at right angles.

3. The oil pump according to claim 1, wherein said corrosion-proof member has a spring force for being urged in an opening direction thereof in said cross section which intersects said center line of one of said suction passage and said bypass passage at right angles, and wherein said corrosion-proof member is fixed by said spring force in at least said one of said suction passage and said bypass passage.

4. The oil pump according to claim 1, wherein said base is formed of aluminum alloy, and said corrosion-proof member is formed of material which is higher than aluminum alloy in average hardness and corrosion resistance.

5. The oil pump according to claim 1, wherein at least a portion being in contact with oil in said corrosion-proof member is mainly formed of ferrous material selected from a group of alloy steel and carbon steel, or ceramic material.

6. The oil pump according to claim 1, wherein said suction passage has a long sideways shape with a long diameter and a short diameter in said cross section, and said corrosion-proof member is disposed in the side of said long diameter of said suction passage.

7. The oil pump according to claim 1, wherein said corrosion-proof member is set to be flat with an inner wall surface at which said corrosion-proof member is disposed in said suction passage and said bypass passage.

8. An oil pump comprising:

a base including an actuating chamber, a suction port, a delivery port, a suction passage for supplying oil to said suction port, a delivery passage into which said oil is delivered from said delivery port, and a bypass passage for communicating with said delivery passage and said suction passage;

a rotor disposed rotatably in said actuating chamber for actuating a pump action to suck said oil in said suction passage from said suction port and to supply said oil to said delivery passage by way of said delivery port; and a flow control valve disposed in said base for returning an excessive oil from said delivery passage to said suction passage as a returning flow of oil by way of said bypass passage when a flow amount of oil is excessive in said delivery passage; and a corrosion-proof member having corrosion resistance, wherein said corrosion-proof member extends over less than half of the at least one of said suction passage and said bypass passage in a circumferential direction of a center line in a cross section which intersects said center line of one of said suction passage and said bypass passage at right angles and is circumferentially positioned in the at least one of said suction passage and said bypass passage to face the returning flow of oil, wherein said flow control valve has a spool for moving in said delivery passage depending on a pressure of said delivery passage, and said base has a balancing concavity into which a part of said returning flow of oil flows from said delivery passage for increasing balance of said spool, wherein said balancing cavity is closed such that any returning oil entering said balancing concavity from said delivery passage can exit said balancing concavity in a reverse direction from the direction of entering the balancing cavity, wherein said bypass passage communicates with a portion which faces to said bypass passage in said delivery passage, and wherein a second corrosion-proof member having corrosion resistance is disposed at a position for facing to a part of said returning flow of oil.

9. The oil pump according to claim 8, wherein said second corrosion-proof member has a cup-shape or a plate-shape.

10. The oil pump according to claim 8, wherein said second corrosion-proof member has an air vent way.

11. The oil pump according to claim 8, wherein said base is formed of aluminum alloy and said second corrosion-proof member is formed of material being higher than aluminum alloy in average hardness and corrosion resistance.

12. The oil pump according to claim 8, wherein at least a part being in contact with oil in said second corrosion-proof member is mainly formed of ferrous material selected from a group of alloy steel and carbon steel, or ceramic material.

* * * * *